US008172591B2

(12) United States Patent
Wertz

(10) Patent No.: US 8,172,591 B2
(45) Date of Patent: May 8, 2012

(54) ELECTRICAL CONNECTOR ASSEMBLY HAVING ELECTRICAL CONNECTOR WITH LOW PROFILE AND PROCESSOR WITH CONE PINS

(75) Inventor: Darrell Lynn Wertz, Chandler, AZ (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 119 days.

(21) Appl. No.: 12/830,413

(22) Filed: Jul. 5, 2010

(65) Prior Publication Data

US 2012/0003846 A1 Jan. 5, 2012

(51) Int. Cl.
*H01R 13/64* (2006.01)

(52) U.S. Cl. ..... 439/246; 439/352; 439/857; 439/876

(58) Field of Classification Search ..... 439/246, 439/249, 252, 856, 857, 876
See application file for complete search history.

(56) References Cited

U.S. PATENT DOCUMENTS 4,229,061 A * 10/1980 Majors ..... 439/217
4,526,429 A * 7/1985 Kirkman ..... 439/82
4,934,967 A * 6/1990 Marks et al. ..... 439/856
5,215,471 A * 6/1993 Reymond et al. ..... 439/66
6,135,784 A 10/2000 Pei
6,142,810 A * 11/2000 Hsiao et al. ..... 439/342
6,371,784 B1 * 4/2002 Scholz et al. ..... 439/342
6,544,064 B1 4/2003 McHugh et al.
6,679,709 B2 * 1/2004 Takeuchi ..... 439/83
7,402,066 B2 * 7/2008 Liao ..... 439/342
2002/0111057 A1 * 8/2002 Bernat et al. ..... 439/246
2004/0229490 A1 * 11/2004 Bernat et al. ..... 439/246

* cited by examiner

*Primary Examiner* — James Harvey

(74) *Attorney, Agent, or Firm* — Andrew C. Cheng; Wei Te Chung; Ming Chieh Chang

(57) ABSTRACT

An electrical connector assembly (100) for mounting to a printed circuit board, comprises a plurality of contacts (3) and a processor (1), the contact (3) comprises a base portion (31), a pair of contacting portions (34) and a solder portion (35) extend from the base portion (31), the processor (1) comprises a plurality of pins (11) each includes a cylinder portion (110) and a cone portion (111) extending downwardly from the cylinder portion (110), the bottom end of the cone portion (111) is thinner than the top end thereof to guiding the pins (11) inserted into the contacts (3), the contacting portions (34) contacts with the cone portion (111) respectively.

14 Claims, 12 Drawing Sheets

ELECTRICAL CONNECTOR ASSEMBLY HAVING ELECTRICAL CONNECTOR WITH LOW PROFILE AND PROCESSOR WITH CONE PINS

BACKGROUND OF THE INVENTION

1. Field of the Invention

The present invention relates to an electrical connector assembly, especially to an electrical connector assembly having electrical connector with low profile and processor having cone pins to make it be assembled to the electrical connector with little force.

2. Description of the Related Art

U.S. Pat. No. 6,135,784 issued to Pei on Oct. 24, 2000 discloses a LIF Pin Grid Array (PGA) electrical connector. The electrical connector comprises an insulative housing with a plurality of contacts received therein and a processor assembled on the insulative housing. The processor includes a plurality of pins connecting with the contacts. The contact comprises a pair of spring arms. When the processor is assembled to the insulative housing, the pin of the processor exerts a force on the two spring arms pushing the spring arms move away from each other, and finally the pin connect with the spring arms. Thus, an electrical connection is established between the processor and the electrical connector. However, the number of the contacts becomes more and more, and the force that exerts on the processor becomes larger and larger. Thus, it is difficult to assemble the processor and the pin is easily deformed.

U.S. Pat. No. 6,544,064 issued to McHugh on Apr. 8, 2003 discloses a ZIF Pin Grid Array (PGA) electrical connector. The electrical connector comprises a base with a plurality of contacts received therein, a cover assembled to the base and a lever assembled between the cover and the base. When the processor is assembled to the electrical connector, the processor and the cover are in the first position that the pins of the processor disconnect with the contacts. Then rotate the lever to make the cover move relative to the base and the processor also moves with the cover to a second position that the pins connect with the contacts. When assembled the processor to the electrical connector, this type of electrical connector is easy to operate and can prevent the deformation of the pins. However, the cover and the lever occupy more space, which violates the development trend of the minimization of the electrical connector.

Hence, an improved electrical connector assembly is required to overcome the disadvantages of the prior art.

SUMMARY OF THE INVENTION

An object of the invention is to provide a low profile electrical connector and can protect the pin of the processor.

To achieve the above-mentioned object, an electrical connector assembly for mounting to a printed circuit board comprises a plurality of contacts and a processor, the contact comprises a base portion, a pair of contacting portions and a solder portion extend from the base portion, the processor comprises a plurality of pins each includes a cylinder portion and a cone portion extending downwardly from the cylinder portion, the bottom end of the cone portion is thinner than the top end thereof to guiding the pins inserted into the contacts, the contacting portions contacts with the cone portion respectively.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiment of the present invention.

Figure 1:
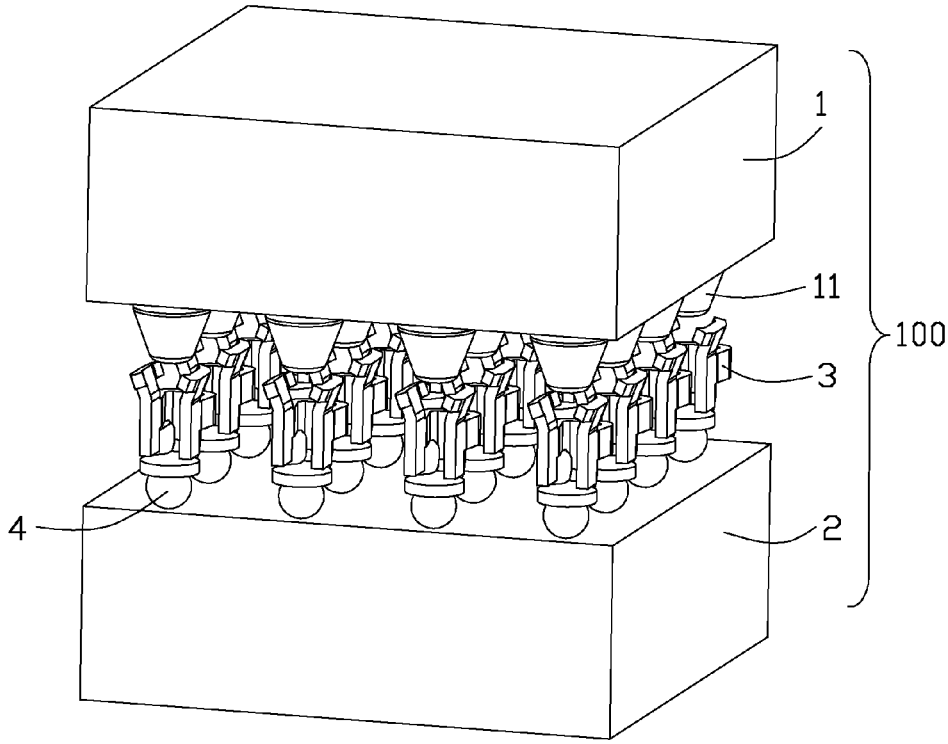
FIG. 1 is an exploded view of an electrical connector assembly in accordance with a first embodiment of the present invention.
Figure 2:
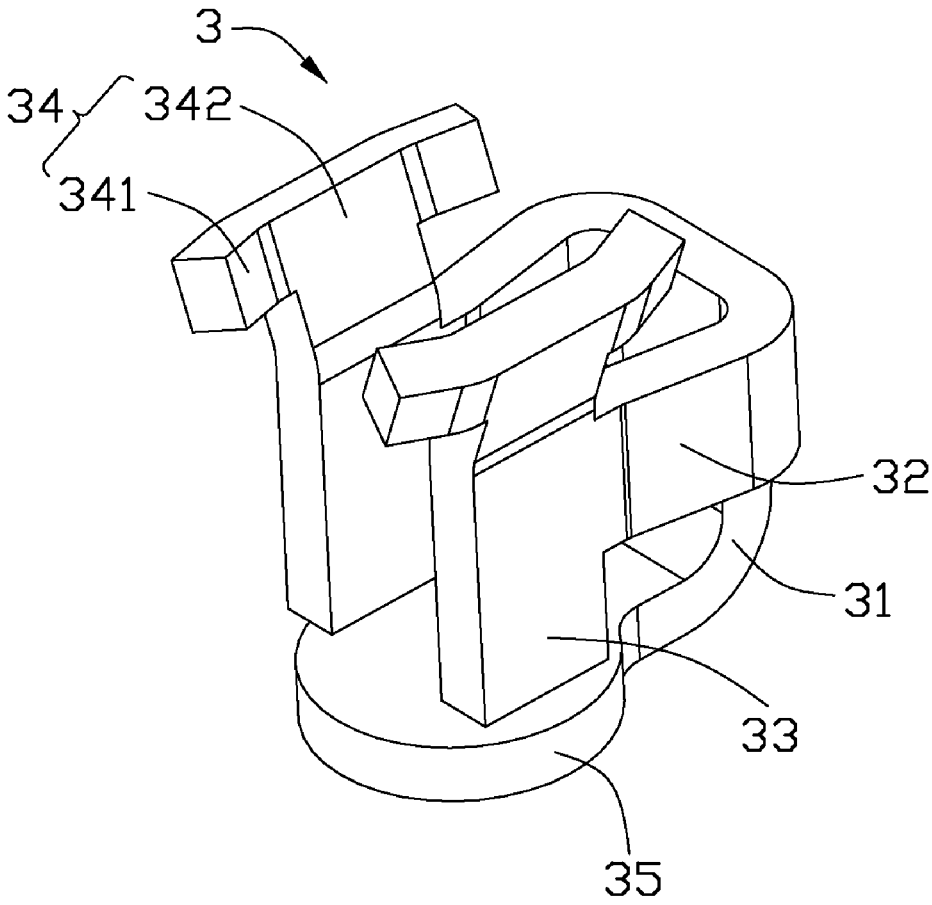
FIG. 2 is a perspective view of the contact of the electrical connector assembly shown in FIG. 1.
Figure 3:
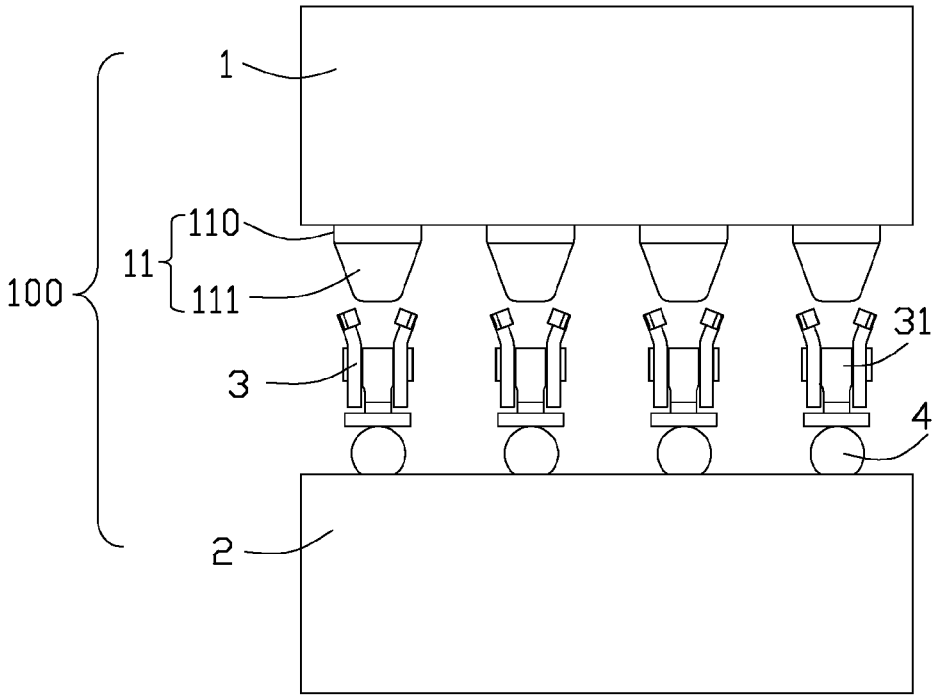
FIG. 3 is a side view of the electrical connector assembly shown in FIG. 1.
Figure 4:
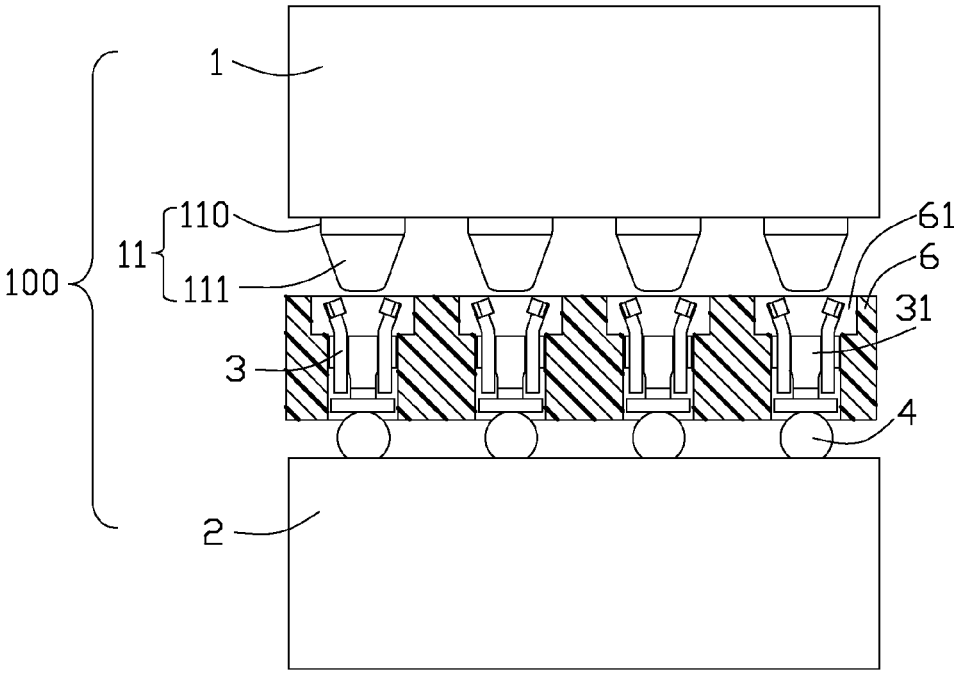
FIG. 4 is an alternative embodiment of FIG. 3, shown an insulative housing surrounding the contacts.
Figure 5:
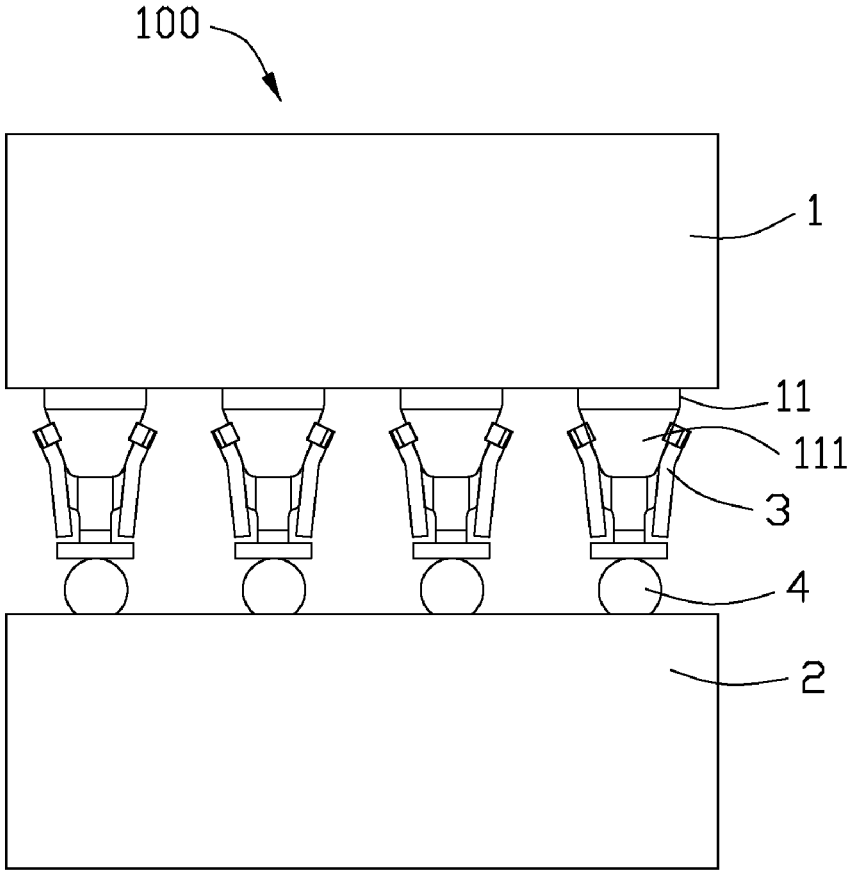
FIG. 5 is an assembled side view of the electrical connector assembly shown in FIG. 3.
Figure 6:
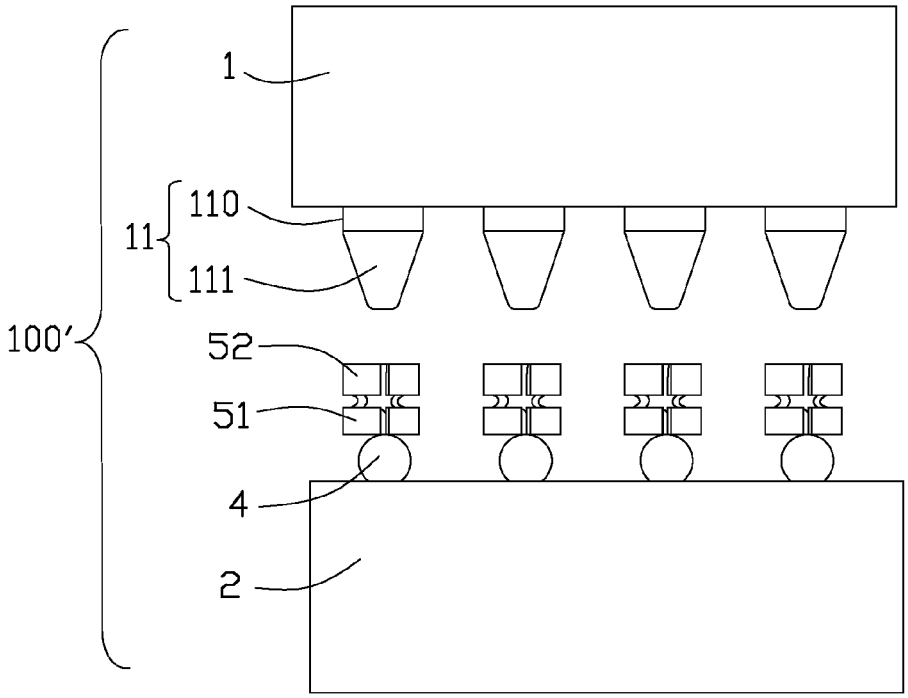
FIG. 6 is an exploded view of an electrical connector assembly according to a second embodiment of the present invention.

Referring to FIGS. 1-3, an electrical connector assembly 100 in accordance with a first embodiment of the present invention comprises a substrate 2, a plurality of contacts 3 soldered to the substrate 2 by solder balls 4 and a processor 1. The processor 1 includes a plurality of pins 11 connecting with the contacts 3. The pin 11 comprises a cone portion 111 at a bottom end thereof and a cylinder portion 110 at a top end thereof. The bottom of the cone portion 111 is thinner than the top thereof. Referring to FIG. 4, an alternative embodiment to FIG. 3, the electrical connector assembly 100 also comprises an insulative housing 6 with a plurality of passageways 61, the contacts 3 are received in the passageways 61.

Referring to FIG. 2, the contact 3 comprises a base portion 31, a pair of connecting portions 32 extending from opposite sides of the base portion 31, a pair of stopper portions 33 extending downwardly from the connecting portions 32, a pair of contacting portions 34 extending upwardly and outwardly from the connecting portions 32, and a soldering portion 35 bending from the base portion 31. The stopper portions 33 extend in a vertical direction and are paralleled to each other. The contacting portion 34 comprises a slant body portion 342 and a pair of additional portions 341 extending from opposite sides of the body portion 342. The angle between the additional portion 341 and the body portion 342 is an obtuse angle. In this embodiment, the size of the space between the contacting portions 34 is larger than the bottom end of the cone portion 111 and is smaller than the top end thereof. When the processor 1 is assembled to the contacts 3, the bottom end of the cone portion 111 is inserted into the space between the contacting portions 341 with lower insertion force.

When the processor 1 is assembled to the contacts 3, the bottom end of the cone portion 111 leads the cone portion 111 to go into the space between the contacting portions 34 easily with less force and can protect the pins 11 from being deformed. In this process, the connecting portions 32 also expand to provide a good holding force to hold the pin 11. At the same time, the stopper portions 33 move to each other to prevent the excessive downwardly movement of the pin 11. When the cone portions 111 of the pins 11 connect with the contacting portions 34, each additional portion 341 provides an additional contacting point between the pin 11 and the contact 3.

Figure 7:
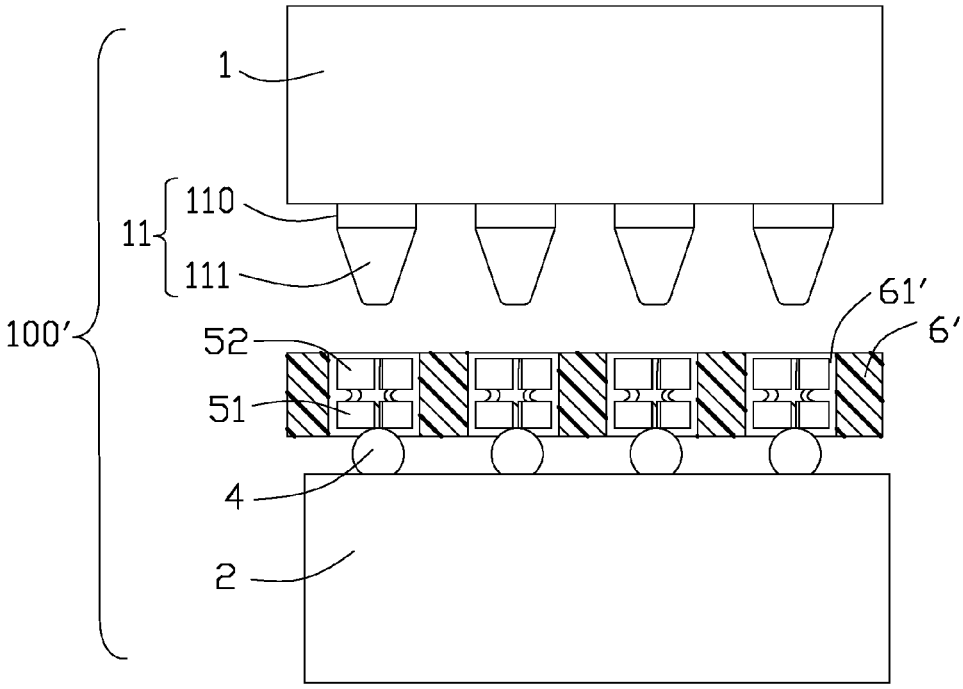
FIG. 7 is an alternative embodiment of FIG. 6, shown an insulative housing surrounding the contacts.
Figure 8:
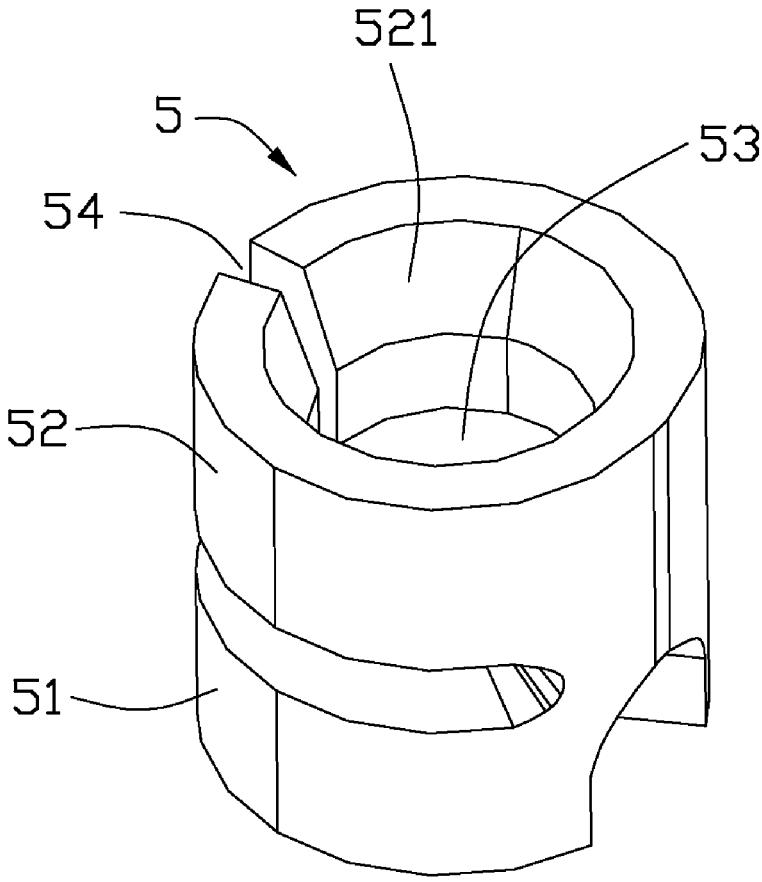
FIG. 8 is a perspective view of the contact shown in FIG. 6.
Figure 9:
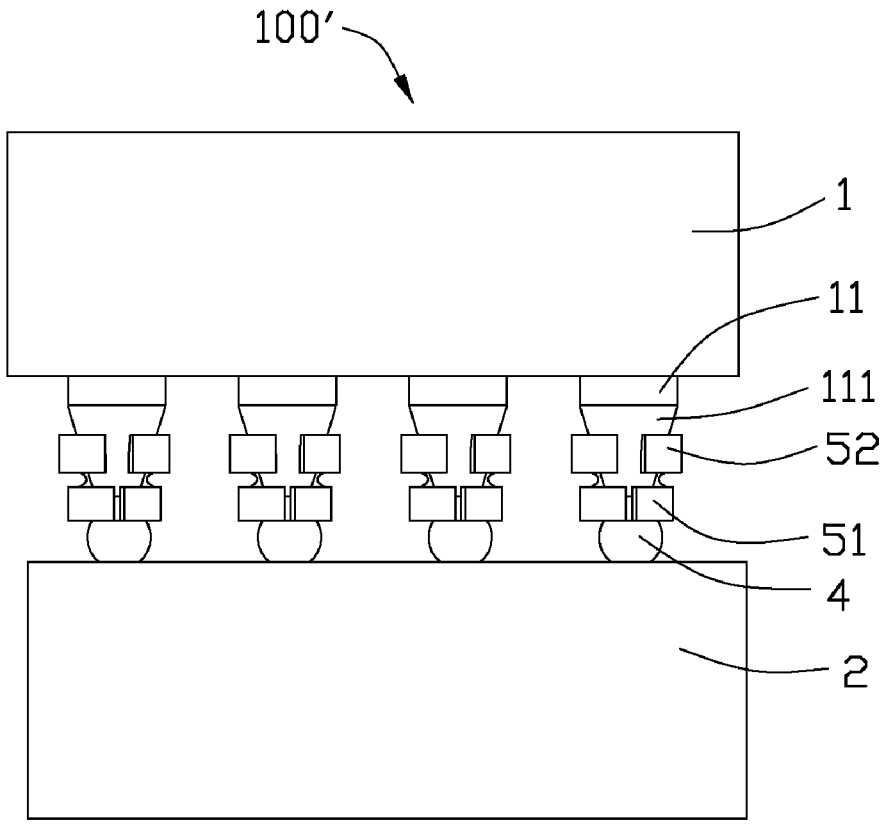
FIG. 9 is an assembled side view of the electrical connector assembly shown in FIG. 6.

Referring to FIGS. 6-9, which shown an electrical connector assembly 100' according to a second embodiment. The contact 5 is configured to a column shape with a through hole 53 impenetrate therethrough. The contact 5 defines a slot 54 to form a pair of contacting portions 52 at the upper end and a pair of spring arms 51 at the lower end. The contacting portions 52 each defines a chamfer portion 521. In this embodiment, the through hole 53 is larger than the bottom end of the pin 11 and is smaller than the top end thereof. When the processor 1 is assembled to the contact 5, the bottom end of the pin 11 is inserted into the through hole 53 with lower insertion force. Referring to FIG. 7, which discloses an alternative embodiment to FIG. 6, the electrical connector assembly 100' also comprises an insulative housing 6' with a plurality of passageways 61', the contacts 5 are received in the passageways 61'.

When the processor 1 is assembled to the contact 5, the bottom end of the cone portion 111 and the chamfer portion 521 lead the pin 11 to go into the through hole 53, the contacting portions 52 are deflected and finally connect with the pin 11. Thus, an electrical connection is established between the processor 1 and the contacts 5. The spring arms 51 are soldered to the substrate 2 through solder balls 4, and the solder balls 4 are positioned between the pair of spring arms 51.

Figure 10:
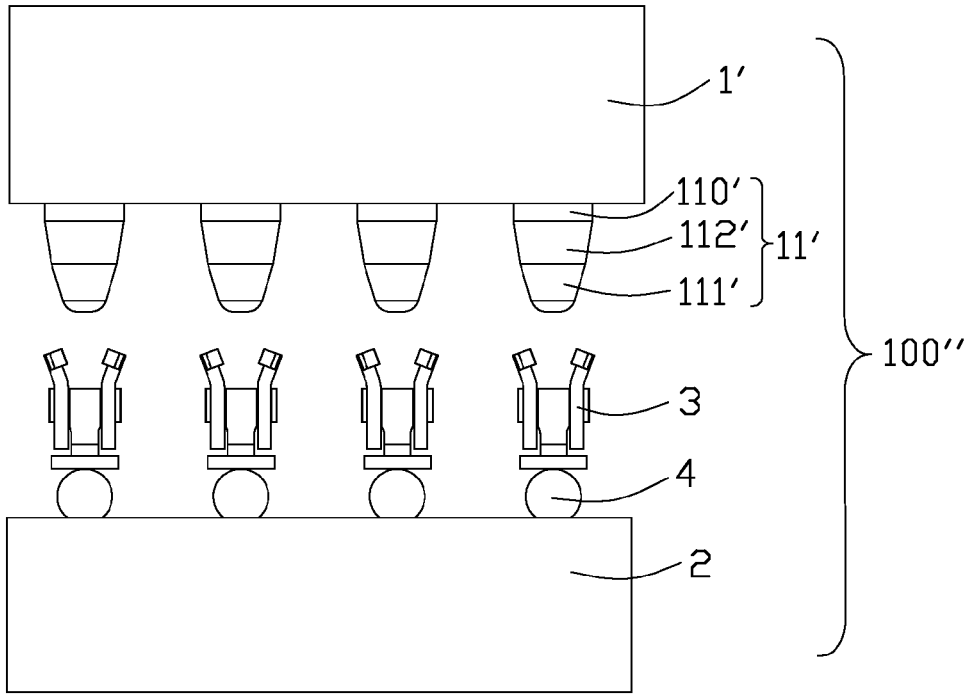
FIG. 10 is an exploded view of an electrical connector assembly according to a third embodiment of the present invention.
Figure 11:
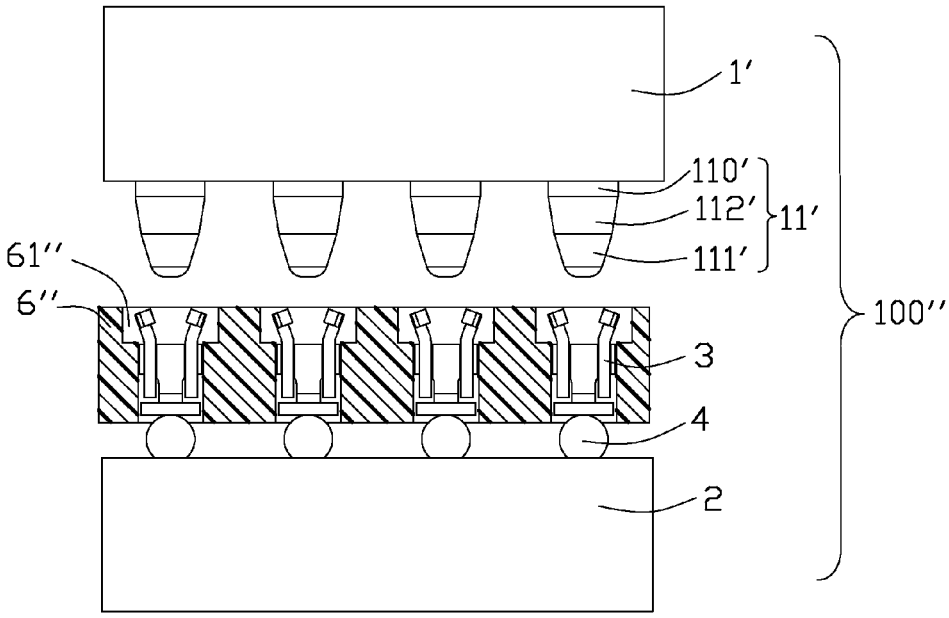
FIG. 11 is an alternative embodiment of FIG. 3, shown an insulative housing surrounding the contacts.
Figure 12:
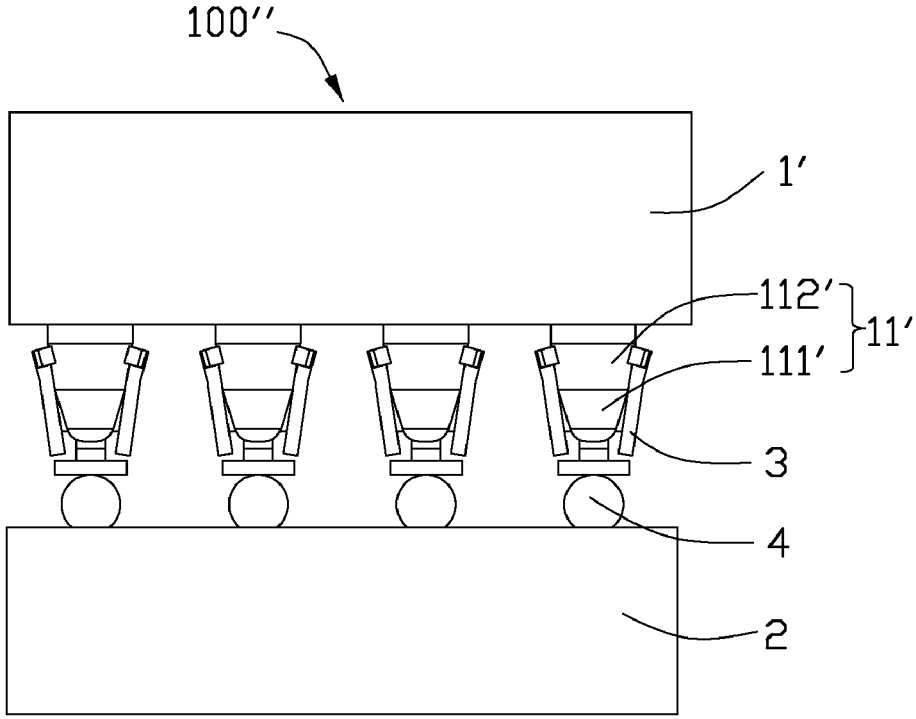
FIG. 12 is an assembled side view of the electrical connector assembly shown in FIG. 10.

Referring to FIGS. 10-12, shown an electrical connector assembly 100" according to a third embodiment. The difference between the pin 11' of the third embodiment and the first embodiment is as following: the cone portion 11' comprises a first cone portion 112' at a free end and a second cone portion 113' between the first cone portion 112' and the cylinder portion 110'. Referring to FIG. 11, an alternative embodiment to FIG. 10, the electrical connector assembly 100" also comprises an insulative housing 6" with a plurality of passageways 61", the contacts 3 are received in the passageways 61".

In this embodiment, the space between the spring arms 34 is larger than the whole first cone portion 112' and is smaller than the second cone portion 111'. When the processor 1' is assembled to the contacts 3, the first cone portion 112' inserts into the space with zero insertion force and leads the second cone portion 111' to connect with the contacting portions 34 with little force. Thus, the pins 11' of the processor 1' are protected.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector assembly for mounting to a printed circuit board, comprising:

a plurality of contacts each comprising a base portion, a pair of contacting portions and a solder portion extending from the base portion; and a processor comprising a plurality of pins each including a cylinder portion and a cone portion extending downwardly from the cylinder portion, the bottom of the cone portion being thinner than the top thereof to guide the pins inserted into the contacts, the contacting portions contacting with the cone portions, respectively; the cone portion comprises a first cone portion at a free end thereof and a second cone portion between the first cone portion and the cylinder portion, and wherein said second cone portion contacts with said pair of contacting portions.

2. The electrical connector assembly as described in claim 1, wherein the distance between the pair of contacting portions is larger than the bottom end of the cone portion and is smaller than the top end of the cone portion.

3. The electrical connector assembly as described in claim 1, wherein the contact also comprises a pair of connecting portions extending from the opposite sides of the base portion and a pair of stopper portions extending downwardly from the connecting portions respectively, and wherein said contacting portions are extending upwardly and outwardly from the connecting portion.

4. The electrical connector assembly as described in claim 3, wherein the two stopper portions each extend in a vertical direction and are paralleled to each other.

5. The electrical connector assembly as described in claim 4, wherein the contacting portion comprises a body portion and a pair of additional portions extending from opposite sides of the body portion, and wherein the body portion and the pair of additional portions contact with the cone portion simultaneously.

6. An electrical connector assembly for mounting on a printed circuit board, comprising:

a plurality of contacts each comprising a base portion, a pair of contacting portions extending from the base portion and a solder portion assembled to the substrate, the base portion defining a receiving space under the pair of contacting portions; and a processor comprising a plurality of pins, each pin including a cylinder portion at an upper end thereof, a leading portion at a free end thereof and a mating portion larger than the leading portion and located between the cylinder portion and the leading portion; and wherein the leading portion of the pin is received in the receiving space and the mating portion contacts with the contacting portion of the contact; the cone portion comprises a first cone portion at a free end thereof and a second cone portion between the first cone portion and the cylinder portion, and wherein said second cone portion contacts with said pair of contacting portions.

7. An electrical assembly comprising:

a first electrical part having a plurality of conductive pins, each of said conductive pins defining an upper cylindrical section and a lower cone section with a downward cone apex;

a second electrical part having a plurality deflectable contacts, each of said contacts defining an upper contact section with an upward diverging shape in compliance with said cone section, and a lower soldering section; and a third electrical part connected to the lower soldering sections via solder balls, respectively; the upper contact section is dimensioned larger than the lower soldering section, and the second electrical part includes an insulative housing with a plurality of passageways configured for compliance with dimensions of the corresponding contacts.

8. The electrical connector assembly as described in claim 1, wherein the contacts are soldered to the printed circuit board directly or through a solder ball.

9. The electrical connector assembly as described in claim 1, further comprising an insulative housing with a plurality of passageways extending therethrough, and wherein the contacts are received in the passageways, respectively.

10. The electrical assembly as claimed in claim 7, wherein the contact includes a base portion with a pair of connection portions extending therefrom, and the upper contact section includes a pair of contacting portions respectively extending upward from the pair of connection portions under condition that joints between the pair of connection portions and the base portion provides primary resiliencies when the conductive pin is coupled to the contact.

11. The electrical assembly as claimed in claim 10, wherein each of said contacting portions defines a body portion and a pair of additional portions by two sides for compliance with a circumference of the cone section.

12. The electrical connector assembly as described in claim 6, wherein further comprises an insulative housing surrounding the contacts.

13. The electrical connector assembly as described in claim 6, wherein the contact also comprises a pair of connecting portions extending from opposite sides of the base portion and a pair of stopper portions extending downwardly from the connecting portions respectively, and wherein said contacting portions are extending upwardly and outwardly from the connecting portion.

14. The electrical connector assembly as described in claim 6, wherein the contacting portion comprises a body portion and a pair of additional portions extending from opposite sides of the body portion, and wherein the body portion and the pair of additional portions contact with the cone portion simultaneously.

* * * * *